US009763014B2

(12) United States Patent
Horbach

(10) Patent No.: US 9,763,014 B2
(45) Date of Patent: Sep. 12, 2017

(54) LOUDSPEAKER WITH PIEZOELECTRIC ELEMENTS

(71) Applicant: Harman International Industries, Incorporated, Stamford, CT (US)

(72) Inventor: Ulrich Horbach, Canyon Country, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 218 days.

(21) Appl. No.: 14/186,951

(22) Filed: Feb. 21, 2014

(65) Prior Publication Data

US 2015/0245144 A1 Aug. 27, 2015

(51) Int. Cl.

| | |
|---|---|
| ***H04R 25/00*** | (2006.01) |
| ***H04R 17/00*** | (2006.01) |
| ***H04R 17/02*** | (2006.01) |

(52) U.S. Cl.

CPC ..... *H04R 17/00* (2013.01); *H04R 17/005* (2013.01); *H04R 17/02* (2013.01); *H04R 17/025* (2013.01); *H04R 2217/00* (2013.01); *H04R 2217/01* (2013.01); *H04R 2217/03* (2013.01)

(58) Field of Classification Search

CPC ..... H04R 2217/00; H04R 2217/01; H04R 2217/03; H04R 17/00; H04R 17/005; H04R 17/02; H04R 17/025

USPC ..... 381/190, 173

See application file for complete search history.

(56) References Cited

U.S. PATENT DOCUMENTS

| | | | | |
|---|---|---|---|---|
| 5,196,755 | A | 3/1993 | Shields | |
| 5,652,801 | A * | 7/1997 | Paddock | H04R 17/00 381/173 |
| 5,727,076 | A * | 3/1998 | Paddock | H04R 17/00 381/174 |
| 6,278,790 | B1 * | 8/2001 | Davis | H04R 7/04 310/324 |
| 2004/0223620 | A1 | 11/2004 | Horbach et al. | |
| 2009/0154735 | A1 * | 6/2009 | Kim | H04R 17/10 381/190 |
| 2011/0051985 | A1 | 3/2011 | Hwang et al. | |
| 2012/0057728 | A1 * | 3/2012 | Fujise | H04R 7/06 381/162 |
| 2012/0099746 | A1 | 4/2012 | Fujise | |

(Continued)

FOREIGN PATENT DOCUMENTS

| | | | |
|---|---|---|---|
| DE | 3143027 | A1 | 5/1982 |
| GB | 1006726 | A | 10/1965 |
| JP | S60182300 | A | 9/1985 |

OTHER PUBLICATIONS

European Patent Office, Extended European Search Report Issued in Patent Application No. 15155548.9, Jul. 6, 2015, 6 pages.

*Primary Examiner* — Duc Nguyen
*Assistant Examiner* — Sean H Nguyen
(74) *Attorney, Agent, or Firm* — McCoy Russell LLP

(57) ABSTRACT

Embodiments are disclosed for a loudspeaker driven by one or more piezoelectric actuators. In embodiments of the disclosure, a loudspeaker comprises a support structure, and a piezoelectric layered cantilever actuator affixed to the support structure via at least two grips. The support structure may also comprise a membrane suspended over the piezoelectric actuator, the membrane being in contact with the piezoelectric actuator between the at least two grips.

20 Claims, 16 Drawing Sheets

(56) References Cited

U.S. PATENT DOCUMENTS

| | | | | |
|---|---|---|---|---|
| 2012/0140969 | A1* | 6/2012 | Fujise | H04R 1/24<br>381/333 |
| 2013/0051585 | A1* | 2/2013 | Karkkainen | H04R 1/1075<br>381/151 |
| 2015/0237440 | A1* | 8/2015 | Fromel | H04R 1/00<br>381/334 |

* cited by examiner

LOUDSPEAKER WITH PIEZOELECTRIC ELEMENTS

FIELD

The disclosure relates to efficient audio transducers utilizing piezoelectric materials and elements to produce audio sounds.

BACKGROUND

In a transducer, energy of one form is converted to energy of a different form. Some loudspeakers may utilize electroacoustic transducers that convert electrical impulses to acoustic vibrations that may be perceived as audible sound to proximate listeners. Conventional electroacoustic transducers, or speaker drivers, include a conical diaphragm and frame with the magnetic sound-producing components mounted to the small end of the cone, leaving the large end of the cone open. Such electroacoustic transducers may be bulky and costly, thereby increasing the size, weight, and cost of the associated loudspeaker. Loudspeakers utilizing piezoelectric transducers typically provide a reduced frequency response and increased distortion compared to other types of transducers (e.g., electroacoustic transducers including magnetic components) due to the piezoelectric actuators providing a primarily capacitive load and the relatively small magnitude of vibration exhibited by piezoelectric actuators.

SUMMARY

Embodiments are disclosed for a loudspeaker driven by one or more piezoelectric actuators. In embodiments of the disclosure, a loudspeaker comprises a support structure, and a piezoelectric layered cantilever actuator affixed to the support structure via at least two grips. The support structure may also comprise a membrane suspended over the piezoelectric actuator, the membrane being in contact with the piezoelectric actuator between the at least two grips.

In additional or alternative embodiments, a loudspeaker may comprise a support structure and an array of piezoelectric layered cantilever actuators arranged linearly along a longitudinal axis of the loudspeaker, each of the piezoelectric actuators being affixed to the support structure via at least two grips. The loudspeaker may also comprise a membrane suspended over the array of piezoelectric actuators, the membrane being in contact with each of the piezoelectric actuators between the at least two grips.

A method of generating sound may be performed by one or more of the disclosed loudspeakers. For example, a method may comprise driving a membrane with one or more piezoelectric actuators at a depressed region of the membrane. Piezo-driven loudspeakers may eliminate bulky, costly magnets from the loudspeaker and increase power efficiency relative to magnet-driven loudspeakers. Driving the membrane at a depressed region of the membrane enables the vibrations of the piezoelectric actuator to be distributed evenly along the membrane. By driving a membrane with piezoelectric actuators as described below, the weight- and cost-saving features described above may be realized without sacrificing bandwidth or other audio quality parameters in the loudspeaker.

BRIEF DESCRIPTION OF THE DRAWINGS

The disclosure may be better understood from reading the following description of non-limiting embodiments, with reference to the attached drawings, wherein below.

DETAILED DESCRIPTION

Many loudspeakers utilize voice coils suspended in a magnetic field to generate sound waves, also known as dynamic loudspeakers that may also use conical diaphragms for propagating sound. Instead of utilizing magnets, piezoelectric speakers produce sound by running an electric current through piezoelectric materials that move to generate sound waves. Piezoelectric speakers may be formed by utilizing materials that exhibit the piezoelectric effect, in that an electrical input on the material causes the material to deflect or exhibit some form of mechanical force or stress. The effect can also be reversed, where a mechanical force applied to the material results in the material developing an electrical charge.

Speakers incorporating piezoelectric drivers, herein described as piezoelectric speakers, may provide several advantages over dynamic loudspeakers. First, the magnets used in dynamic loudspeakers are often large in order to produce adequate sound, whereas piezoelectric speakers do not need magnets and therefore may have smaller components. Similarly, piezoelectric speakers can be housed in shallow profiled housings and the shape may be conformed to fit in a space according to a particular design requirement. An example may involve mounting a flat piezoelectric speaker on a wall for a home entertainment system. Furthermore, piezoelectric speakers may be more power-efficient than speakers that utilize other types of drivers. Throughout this description, the terms piezoelectric drivers, transducers, and actuators will be used synonymously.

Figure 1:
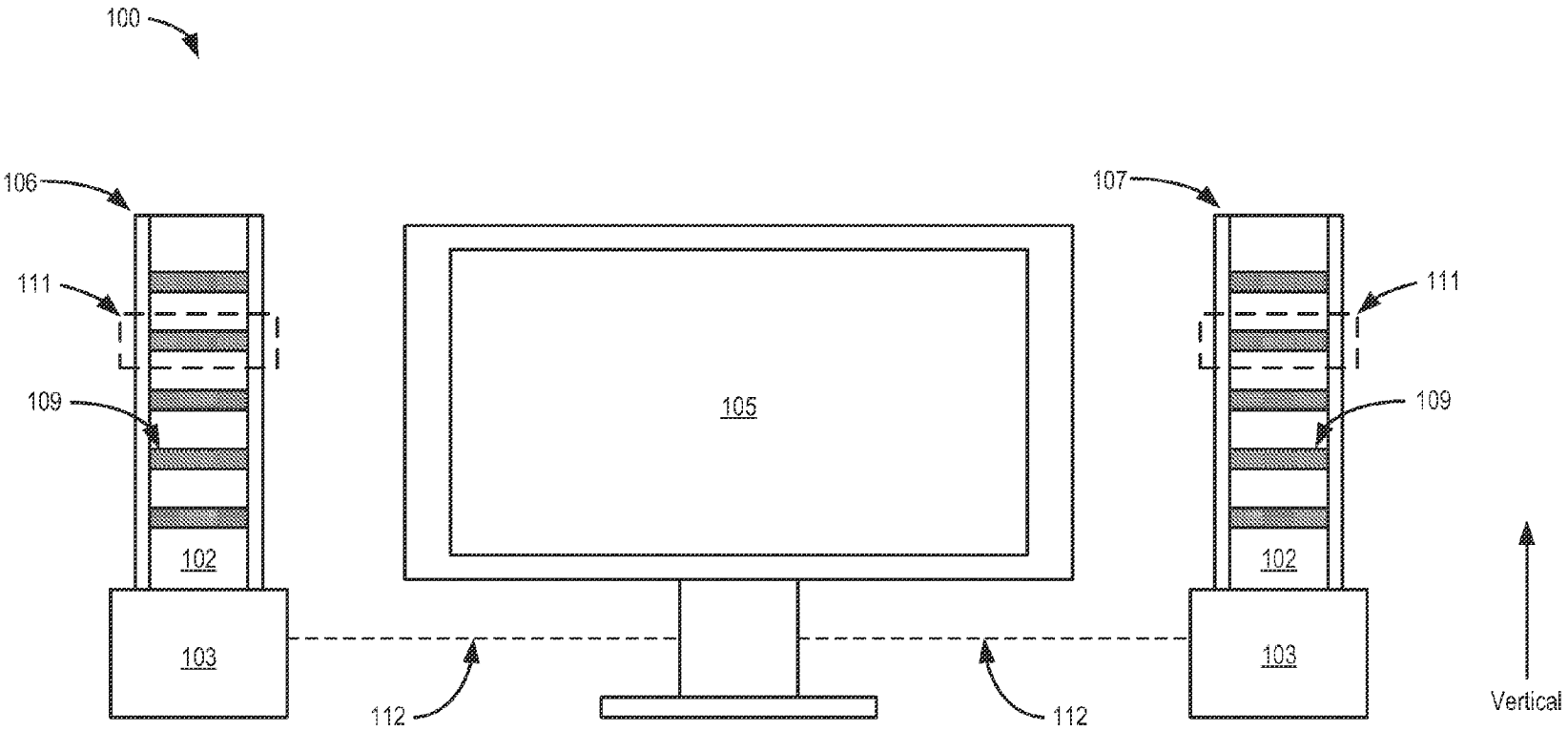
FIG. 1 shows a piezoelectric speaker system in accordance with one or more embodiments of the present disclosure.

An example of a piezoelectric speaker system 100 is shown in FIG. 1. In this setup, a left piezoelectric speaker 106 and a right piezoelectric speaker 107 are arranged and connected to provide sound to a room or other space. In this system, speakers 106 and 107 may be connected to an external desktop computer 105 such that the computer acts as an audio source for providing signals to the speakers. Speakers 106 and 107 are substantially identical in shape and form, and therefore the features of each speaker is the same and labeled identically. The piezoelectric speaker may contain two general sections, the first being a tower 102 that provides structure and support for the piezoelectric systems. The second general section may be a base 103 which may be adjacent to and attaches to tower 102. The base may provide a foundation for the piezoelectric speaker and house additional components needed for the speaker. Furthermore, a multitude of audio signal ports may be built into base 103, where wiring 112 may connect speakers 106 and 107 to computer 105. Wiring 112 may also provide power to speakers 106 and 107 from computer 105, or in another embodiment, power may be supplied from a separate source via different wiring (not shown).

Within tower 102 one or more piezoelectric elements 111 are housed, as shown by the dashed boxes. Each element 111 includes a piezoelectric actuator 109 along with any surrounding structure and material that is required to produce sound. The surrounding structure, as described in more detail in FIG. 3, may include grips and/or adhesive for holding the actuator in place, wiring, and a diaphragm or other piece for producing pressure waves. In the example shown in FIG. 1, five piezoelectric elements 111 are present in each of the speakers 106 and 107, where the elements are arranged in a vertical fashion.

Figure 2:
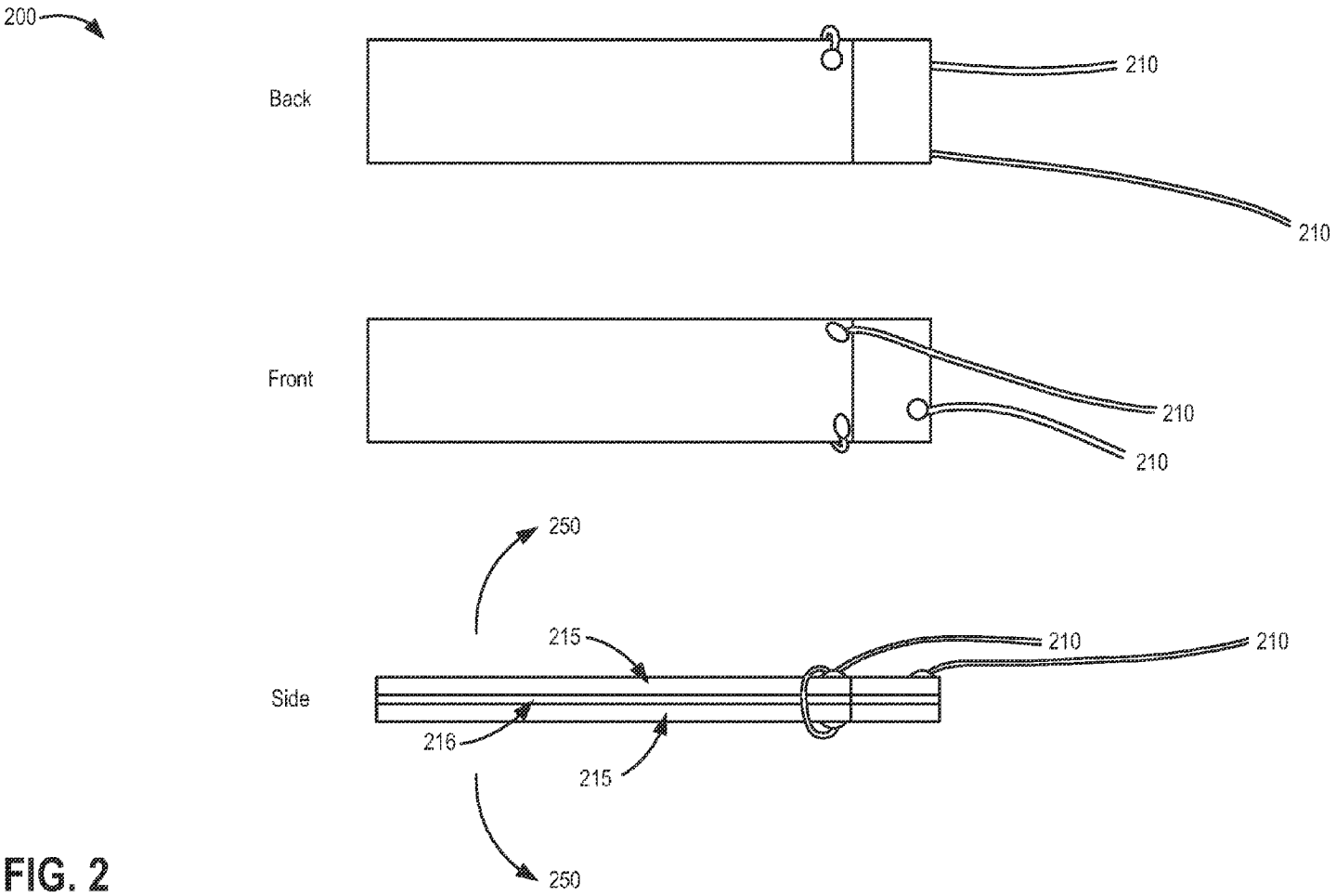
FIG. 2 shows a piezoelectric bimorph actuator in accordance with one or more embodiments of the present disclosure.

Piezoelectric transducers (actuators), such as actuator 109 in FIG. 1, may come in a variety of forms and sizes. One variety of transducer is the piezoelectric bimorph. A piezo bimorph may be substantially planar and rectangular in shape, thereby enabling the bimorph to be physically constrained to deflect in only two directions. An example piezo bimorph is shown in FIG. 2. Three views of bimorph 200 are shown in FIG. 2, including a front, back, and side view, as labeled. Bimorph 200 may be used as actuator 109 in FIG. 1. Looking at the side view in FIG. 2, a center material 216, which may be a ceramic material, is sandwiched in between two outer layers of a piezoelectric material 215. The piezoelectric material may be a piezoceramic or other suitable thin and flexible material that exhibits the piezoelectric effect. The two layers of piezoelectric material 215 differentiates bimorph 200 from a unimorph, wherein a single layer of piezoelectric material is used. As an electrical signal is passed through leads 210, bimorph 200 flexes back and forth along its length in directions as designated by arrows 250. On some piezoelectric speakers, the bimorph may be attached to a support structure on one end, thereby allowing free movement of the other end. This configuration is hereafter referred to as a single-clamped bimorph.

Figure 3:
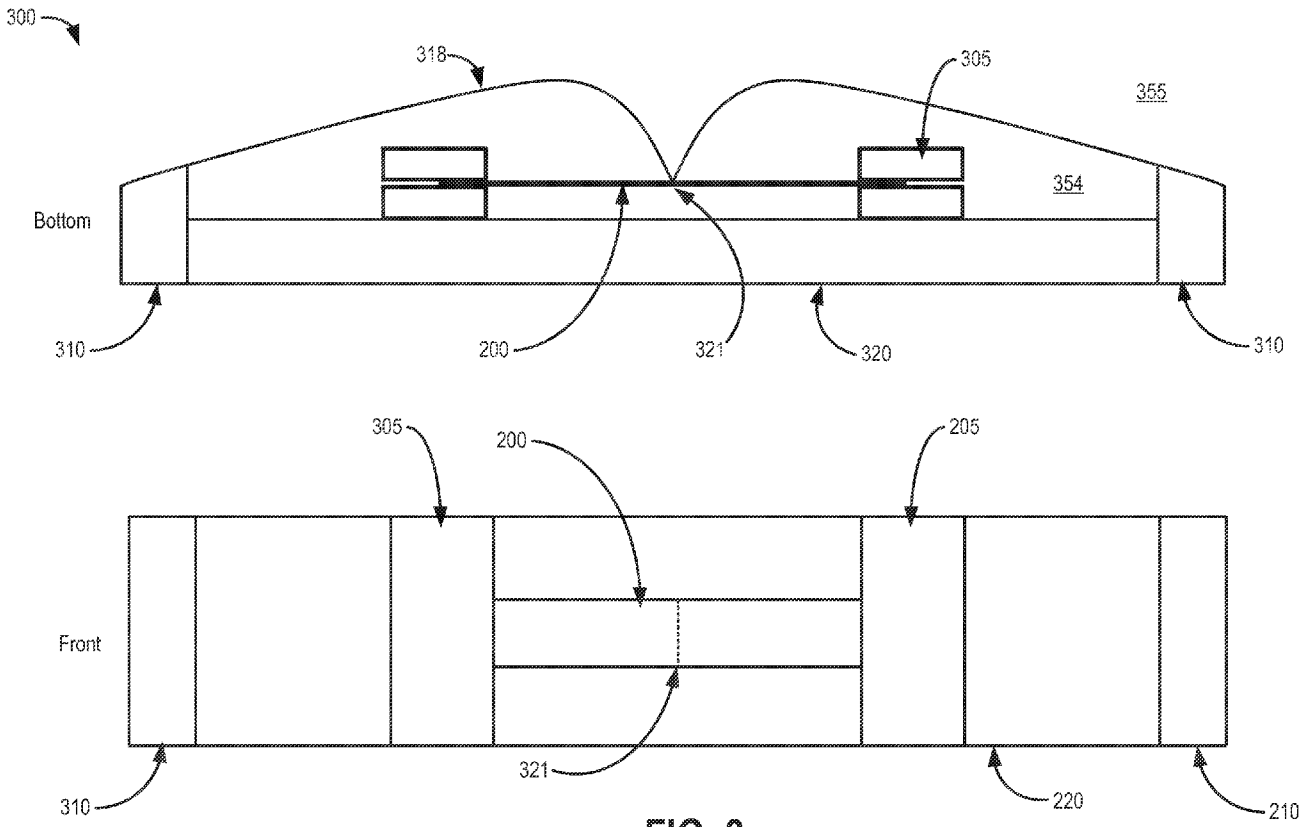
FIG. 3 shows a piezoelectric element of a loudspeaker in accordance with one or more embodiments of the present disclosure.

As opposed to rigidly fixing one end of a bimorph actuator, sound quality may be enhanced by fixing the bimorph on both ends and allowing the bimorph to move in between the two fixed ends. A first embodiment of a single element 300 of a piezoelectric speaker is shown in FIG. 3, where the element is fixed on both ends. Two views of element 300 are shown, including a front view and a bottom view, as labeled. Throughout this description, the piezoelectric element 300 forms the basis for any speaker system described. A plurality of elements 300 may be combined and arranged to form element arrays that may be wired to produce coherent sound. As seen, a bimorph 200 is clasped on both ends by grips 305 (e.g., each grip being attached to a different, opposing end of the bimorph 200). While the bimorph 200 illustrated in FIG. 3 corresponds to the bimorph 200 of FIG. 2, it is to be understood that any suitable piezoelectric actuator may be utilized where bimorph 200 is referenced in the disclosure. The grips 305 may be rigidly clamped to the bimorph 200 such that there is substantially zero displacement between the bimorph and its grips. The grips 305 may be composed of a firm, yet flexible material such as rubber. Furthermore, the grips may use compressive force and friction to hold the bimorph in place, or a form of adhesive may be applied to the grips and bimorph. Notice that each grip 305 clamps an end of the bimorph between two layers. In this way, the grip 305 contacts a front surface and a rear surface of the bimorph (e.g., a surface opposite of the front surface) to enclose the end of the bimorph. This style of clamping, where bimorph 200 is fixed on both ends, is hereafter referred to as a double-clamped bimorph. One layer of the grips is in direct contact and adjacent to a support structure, such as substrate 320, which may provide a generally flat surface onto which grips 305 may be attached. Side support structures 310 are positioned on opposite end surfaces of substrate 320 to further support the bimorph, grips, and substrate. Structures 310 may comprise the shape of elongated posts, as further shown and described later. A space exists between structures 310 and grips 305, along with a space in between bimorph 200 and structures 310. In this way, bimorph 200 is a layered piezoelectric cantilever affixed to support substrate 320 (e.g., a support structure).

A thin, flexible membrane 318 is formed and suspended over bimorph 200 in the shape of an "M" where the membrane 318 touches bimorph 200 along a line 321 at the center of the bimorph. At line 321 the membrane may contact the bimorph via some form of adhesive and/or other fastening or fusing material/process. As illustrated, the ends of membrane 318 are fixed to support structures 310. It is to be understood that the ends of membrane 318 may additionally or alternatively be fixed to other support structures, such as substrate 320. Membrane 318 may be a thin, film-like membrane composed of a vibration-resistant plastic material. An electric current passes through bimorph 200 that may vibrate membrane 318, thereby producing sound waves. As shown in later figures, element 300 may be repeated to form an array of bimorph actuators, all connected to a single continuous membrane, in one example. Membrane 318 may be suspended over bimorph 200 in order to form a canopy over bimorph 200 (e.g., the piezoelectric actuator) and grips 305, where there is a space existing between the grips and bimorph (at locations other than line 321, where there is direct contact between the membrane and actuator). For example, membrane 318 may be in contact with the bimorph 200 at a center of the bimorph between the grips 305. In this way, membrane 318 may only be in contact with the bimorph at a central point and/or region on a front surface of the bimorph, and may not be in contact with the bimorph in other points, regions, and/or surfaces of the bimorph (e.g., in regions spaced from the center of the bimorph). Membrane 318 may be continuously attached to structures 310 so as to form a pocket of air or other material 354 within element 300 that is separated from an exterior side 355.

To quantify the acoustical properties of piezoelectric bimorph actuators clamped on both ends with flexible grips as opposed to the single-clamped bimorph, a series of tests may be performed, the results of which are explained in detail below. Throughout the following tests, the single-clamped bimorph is clamped on one side with a hard, rigid material such as metal or a hard plastic, whereas the double-clamped bimorph is held on both ends with a softer material (such as rubber).

Figure 4:
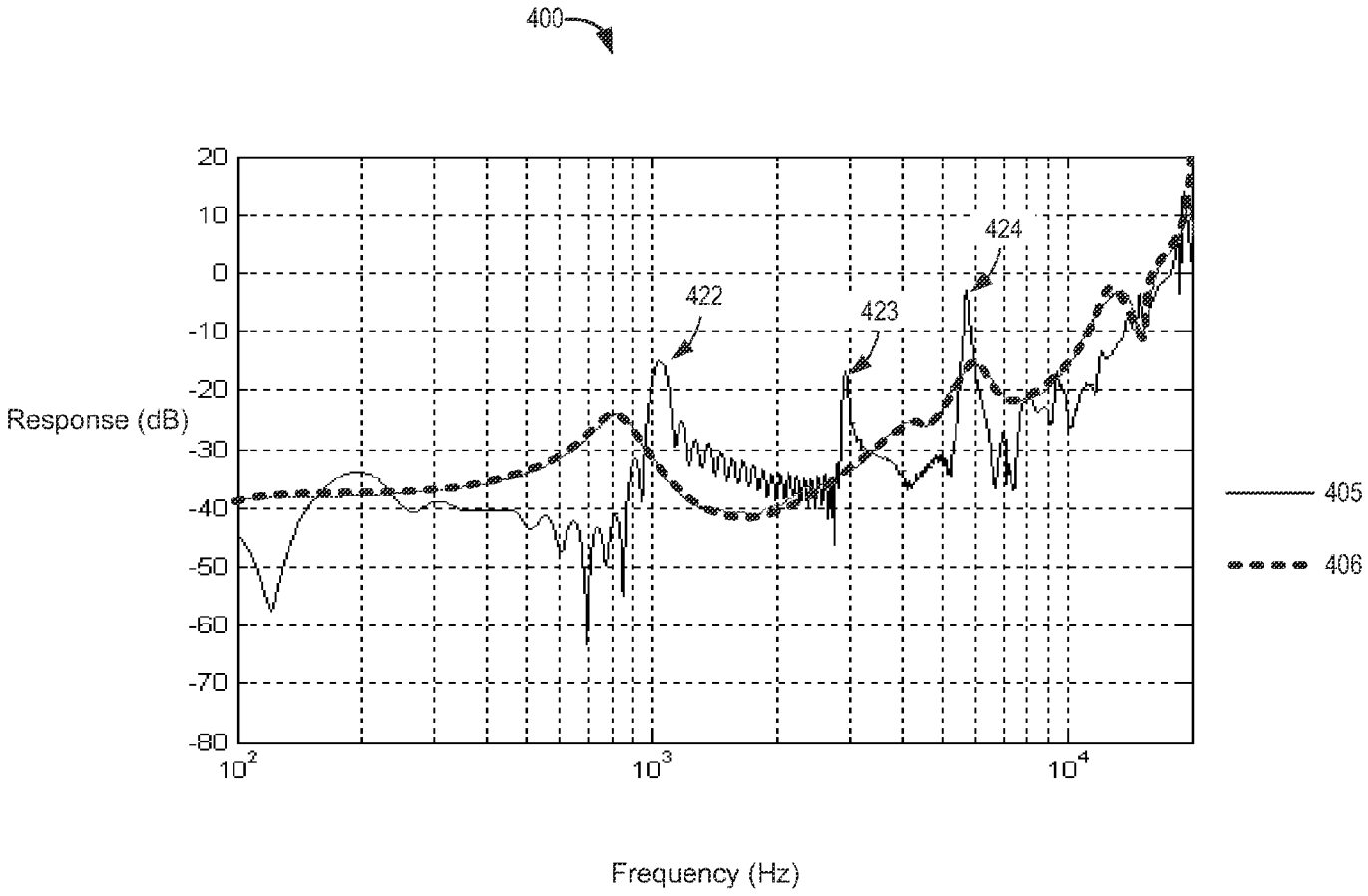
FIG. 4 shows frequency responses of a single and double-clamped piezoelectric actuator in accordance with one or more embodiments of the present disclosure.

In a frequency response test shown in FIG. 4, a small microphone may be placed in front of a piezoelectric bimorph with no membrane 318 attached. As such, graph 400 shows the frequency responses of the single-clamped and double-clamped bimorphs as described with relation to FIG. 3. Curve 405 represents the frequency response of the bimorph clamped on one end with a hard material, whereas curve 406 represents the frequency response of the bimorph clamped on both ends with a softer material. For the bimorph clamped on one end, the microphone may be held proximate to the free end whereas the microphone may be held proximate to the center of the bimorph, such as along line 321. Notice that curve 406 is steadier and smoother than curve 405, exhibiting enhanced acoustical performance over curve 405. In curve 405, acoustical energy is concentrated around several sharp resonance peaks such as at points 422, 423, and 424. The sharp resonance peaks may render the bimorph clamped on one end unsuitable for speaker applications that require high audio quality. Curve 406, on the other hand, does not exhibit the resonance peaks as severe as those shown in curve 405.

Figure 5:
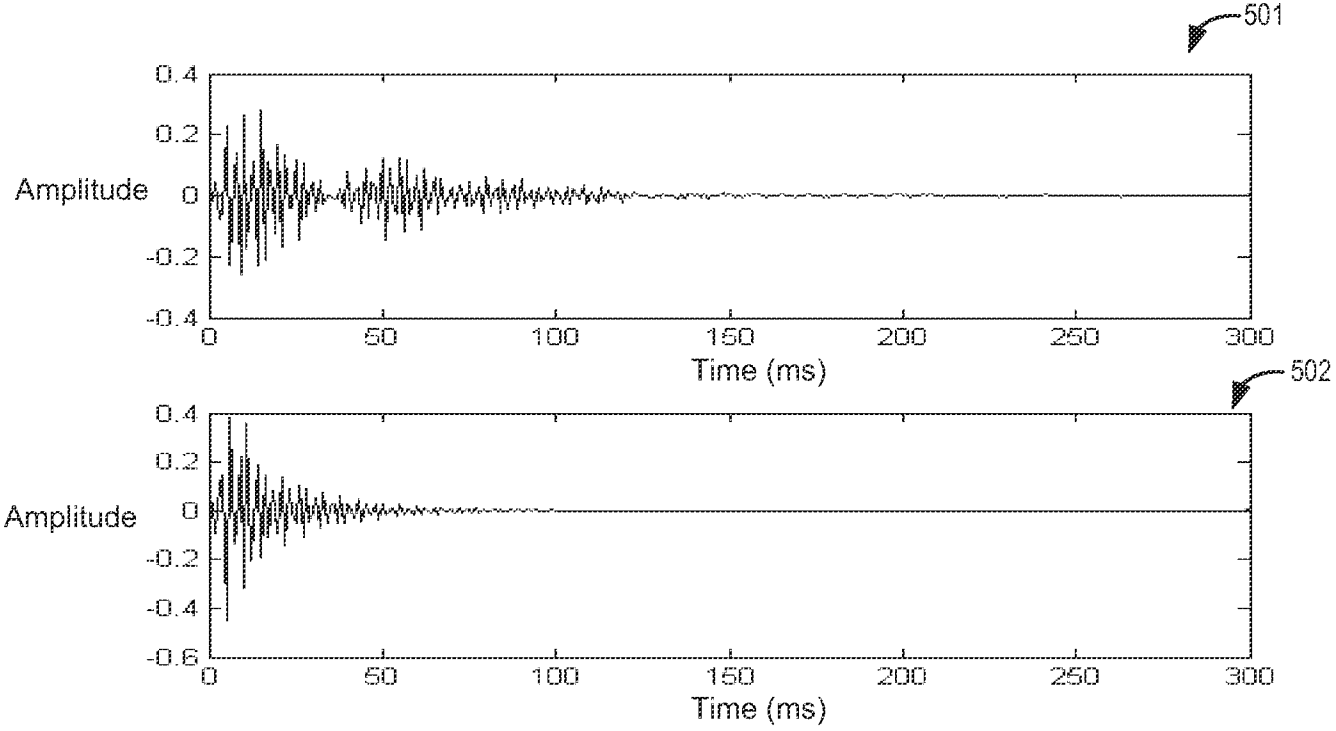
FIG. 5 shows impulse responses for a single and double-clamped piezoelectric actuator in accordance with one or more embodiments of the present disclosure.

A second test can be seen in FIG. 5, wherein both the single-clamped and double-clamped bimorphs are subjected to an impulse response test. The impulse responses exhibited by both bimorphs illustrate the damping effect and resulting concentration of energy during a period of time. A possible impulse response of the single-clamped bimorph can be seen in FIG. 5 as graph 501. The double-clamped bimorph may have an impulse response shown by graph 502. Notice that the sharp oscillatory behavior of single-fixed bimorph graph 501 extends for a longer period of time than the graph 402 of the double-clamped bimorph. In graph 501, the impulse response contains locations at which the amplitude rises again before decaying, whereas the impulse response of graph 502 has a maximum then continually decays.

As previously mentioned, a piezoelectric speaker unit may contain an array of piezoelectric elements, wherein each element may be configured as element 300. In one example, five elements may be arranged in a vertical (longitudinal) manner such that a single membrane 318 is attached. With multiple elements, a wiring scheme may be needed to direct input signals to each element, whereby resistors may be used to divide the audio signal into distinct frequency bands for each element accordingly. In this setup, the resistors may form part of a crossover unit. The five-element array of elements (each containing an actuator) may be assumed for the piezoelectric speaker unit illustrated and tested in FIGS. 6-9.

Figure 6:
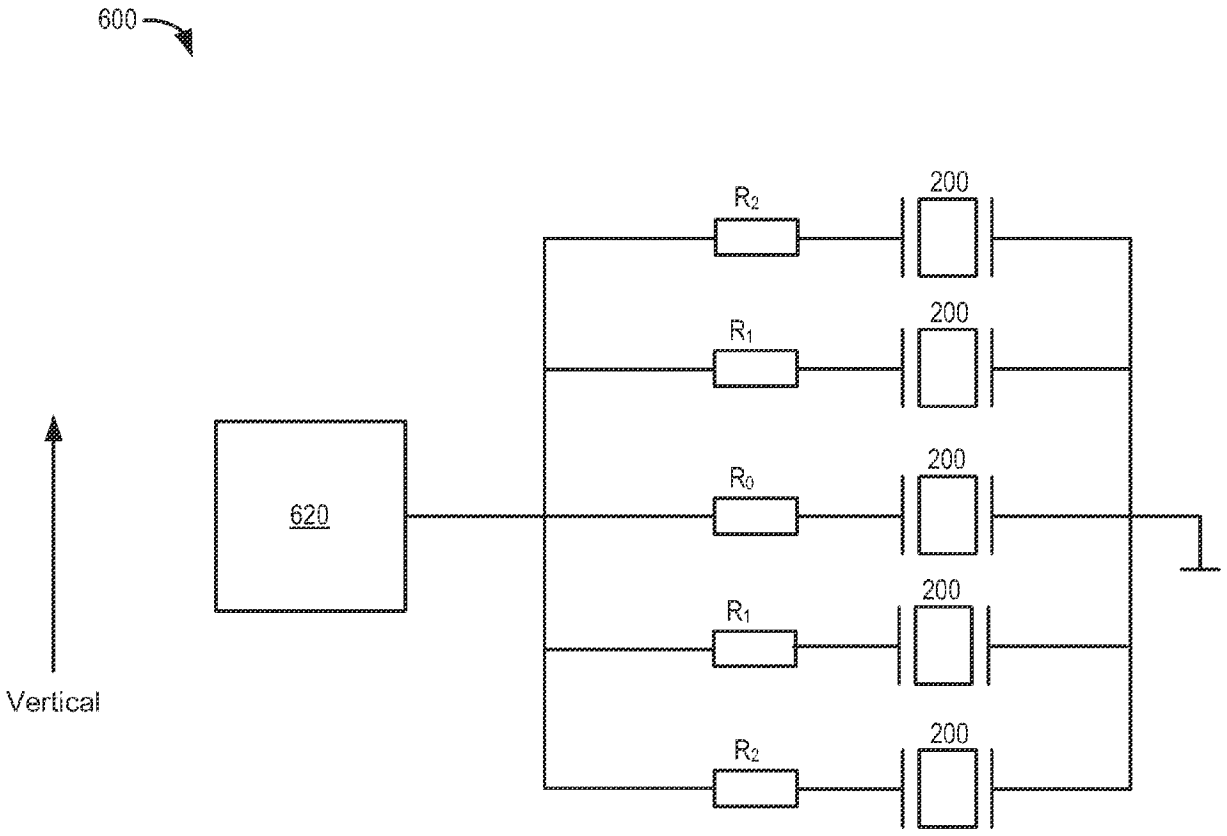
FIG. 6 shows an electronic schematic of a first piezoelectric array in accordance with one or more embodiments of the present disclosure.

FIG. 6 illustrates an example wiring schematic, wherein five piezoelectric bimorphs 200 are arranged in parallel with five resistors and an input signal from an external amplifier 620 to form a speaker unit 600. As seen, in each branch of the parallel circuit a bimorph 200 (e.g., a transducer) is arranged in series with a corresponding resistor. Resistors, labeled as $R_0$, $R_1$, and $R_2$, may be arranged in a symmetrical profile as displayed in FIG. 6 to produce balanced sound. As an example, the resistors may exhibit resistances (measured in ohms) as follows: $R_0$=10 ohms, $R_1$=$R_2$=400 ohms. The difference in resistance between the center resistor and outer resistors may cause a gradual high frequency roll-off towards the edges of membrane 318, if the elements were arranged such that all were attached to a single membrane 318. The high frequency roll-off may improve the vertical directivity of the produced sound and overall acoustic power response.

Figure 7:
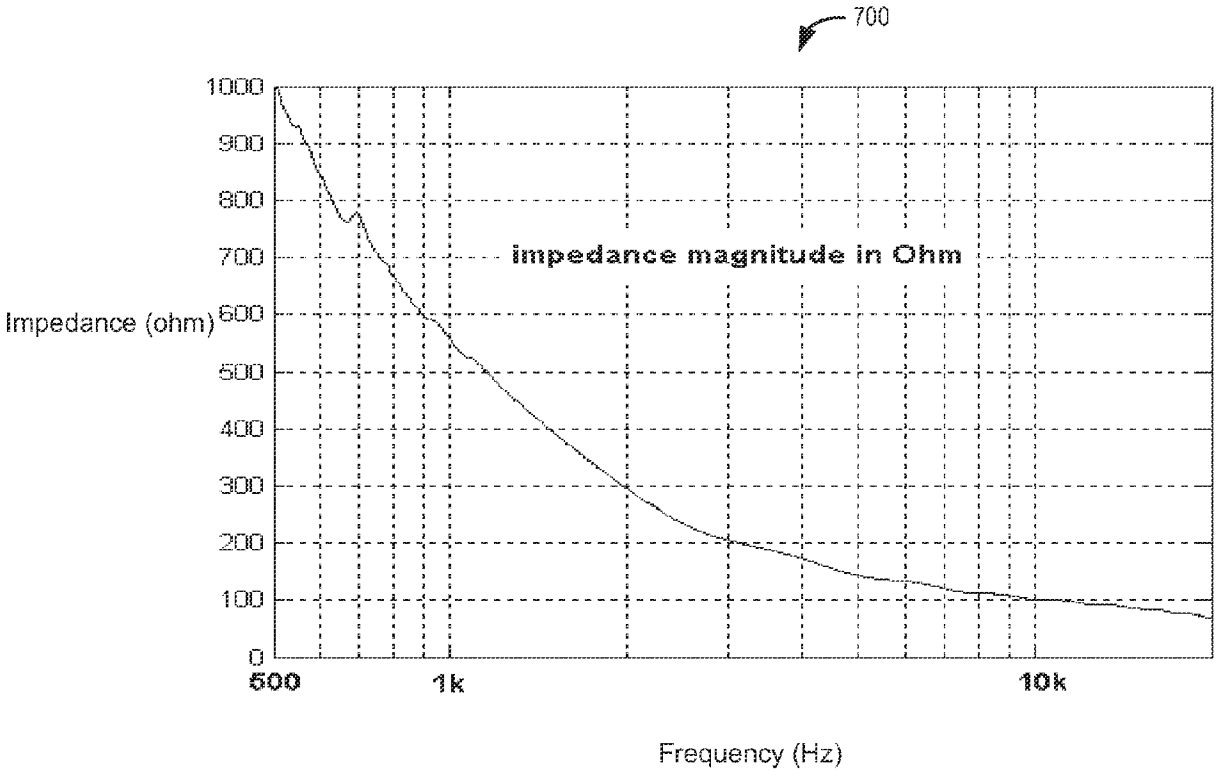
FIG. 7 shows input impedance of the array of FIG. 6 in accordance with one or more embodiments of the present disclosure.
Figure 8:
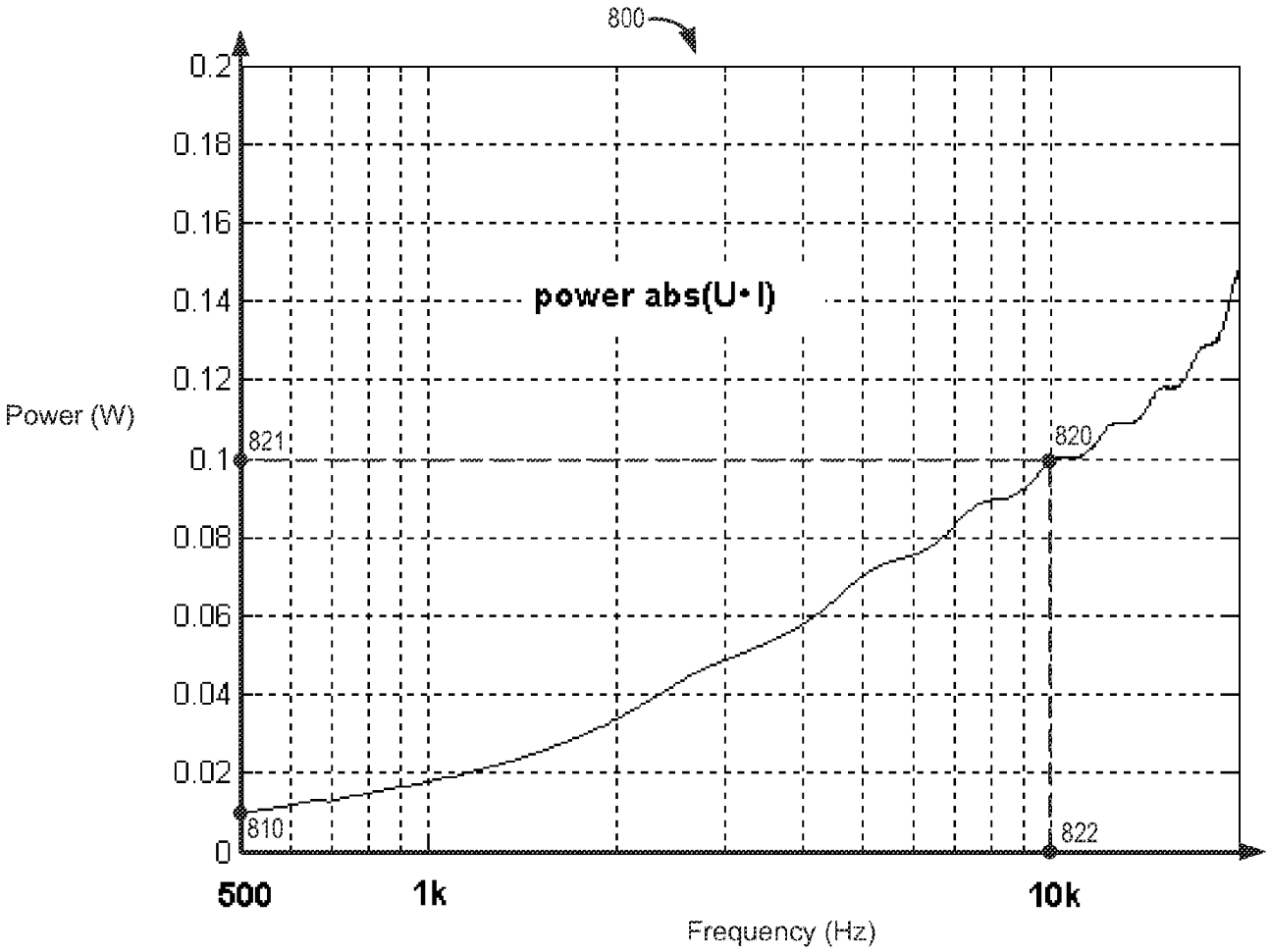
FIG. 8 shows power requirement of the array of FIG. 6 in accordance with one or more embodiments of the present disclosure.

Utilizing the five-element array as described with regard to FIG. 6, FIG. 7 shows the input impedance (amplifier load) that may be exhibited by the five-element piezoelectric bimorph array in a speaker unit. Graph 700 shows the relationship of impedance (measured in ohms) versus frequency (measured in Hz). The five-element array may be driven by a constant voltage of 10 $V_{RMS}$, which may result in an approximately 80 dB sound pressure level (SPL) at a distance of 3 m from the array. For this setup, the dynamic power requirements are shown in FIG. 8, wherein graph 800 illustrates that as frequency output increases, the demanded power also increases. For example reference values, point 810 corresponds to 500 Hz and 10 mW, while point 820 corresponds to 10 kHz (point 822) and 100 mW (point 821).

Figure 9:
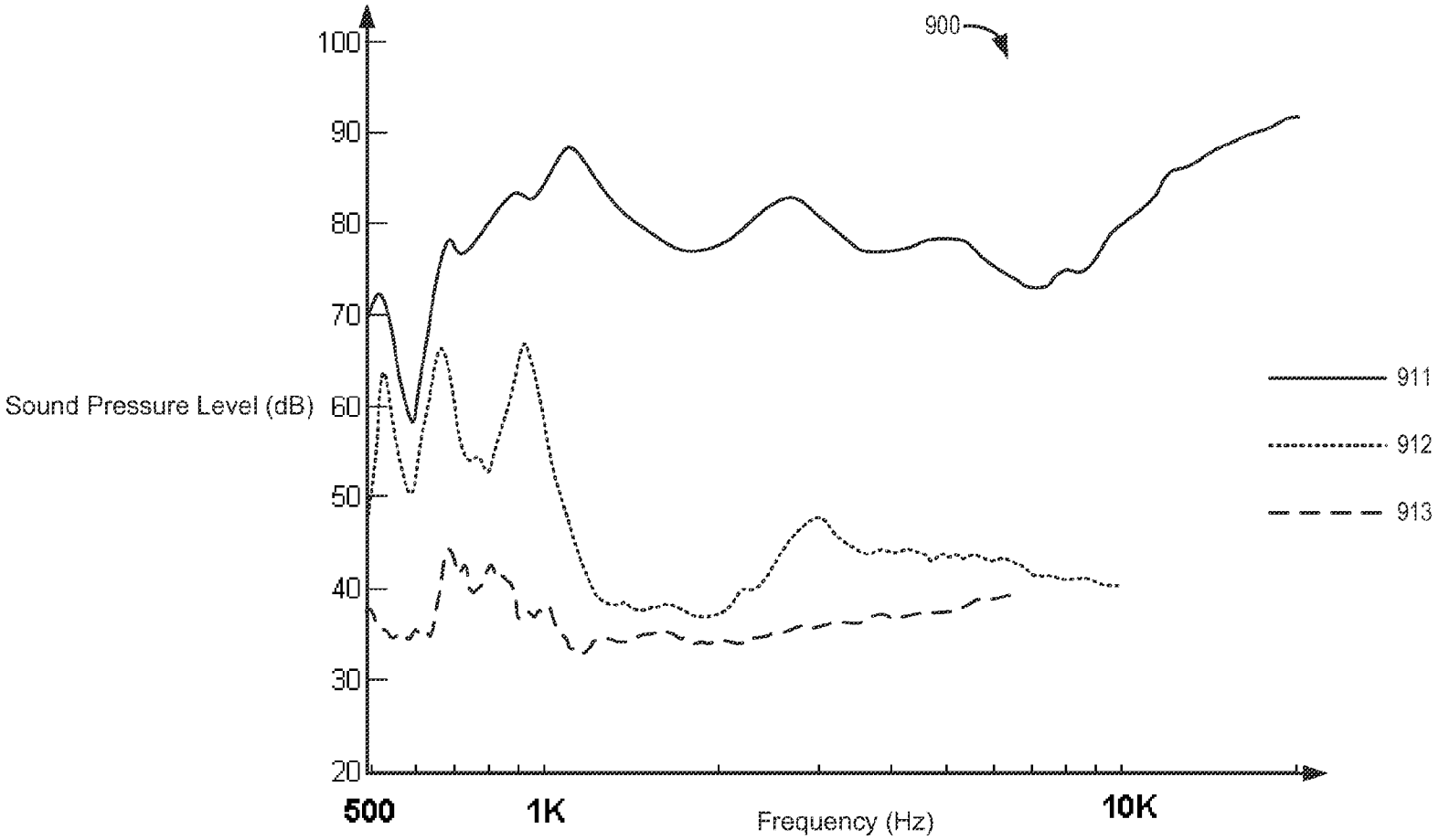
FIG. 9 shows sound pressure level of the array of FIG. 6 in accordance with one or more embodiments of the present disclosure.

Using the same five-element array of piezoelectric bimorphs, a possible frequency response and distortion for the five-element array is shown in FIG. 9 as graph 900, where frequency lies along the horizontal axis and SPL lies along the vertical axis. Three graphs are shown, including the fundamental frequency response 911, $2^{nd}$ order harmonic distortion 912, and $3^{rd}$ order harmonic distortion 913. Notice that the fundamental frequency response 911 is smooth and well-behaved, and furthermore may be equalized by low-order filters, such as infinite impulse response (IIR) filters. Furthermore, the $2^{nd}$ and $3^{rd}$ order harmonic distortion curves 912 and 913 may be less than 1%, or about −40 dB, above 1 kHz, which is a comparable figure with a conventional electrodynamic tweeter.

The aforementioned five-element array of piezoelectric bimorph actuators may be arranged in an elongated structure and attached to a base and/or other components to form a piezoelectric loudspeaker unit. The array may be arranged linearly along a longitudinal (vertical) axis of the loudspeaker. One embodiment of a piezoelectric loudspeaker 1000 is displayed from different angles in FIGS. 10-13. It is noted that FIGS. 10-13 are drawn to scale but different relative dimensions may be used in embodiments not shown.

Figure 10:
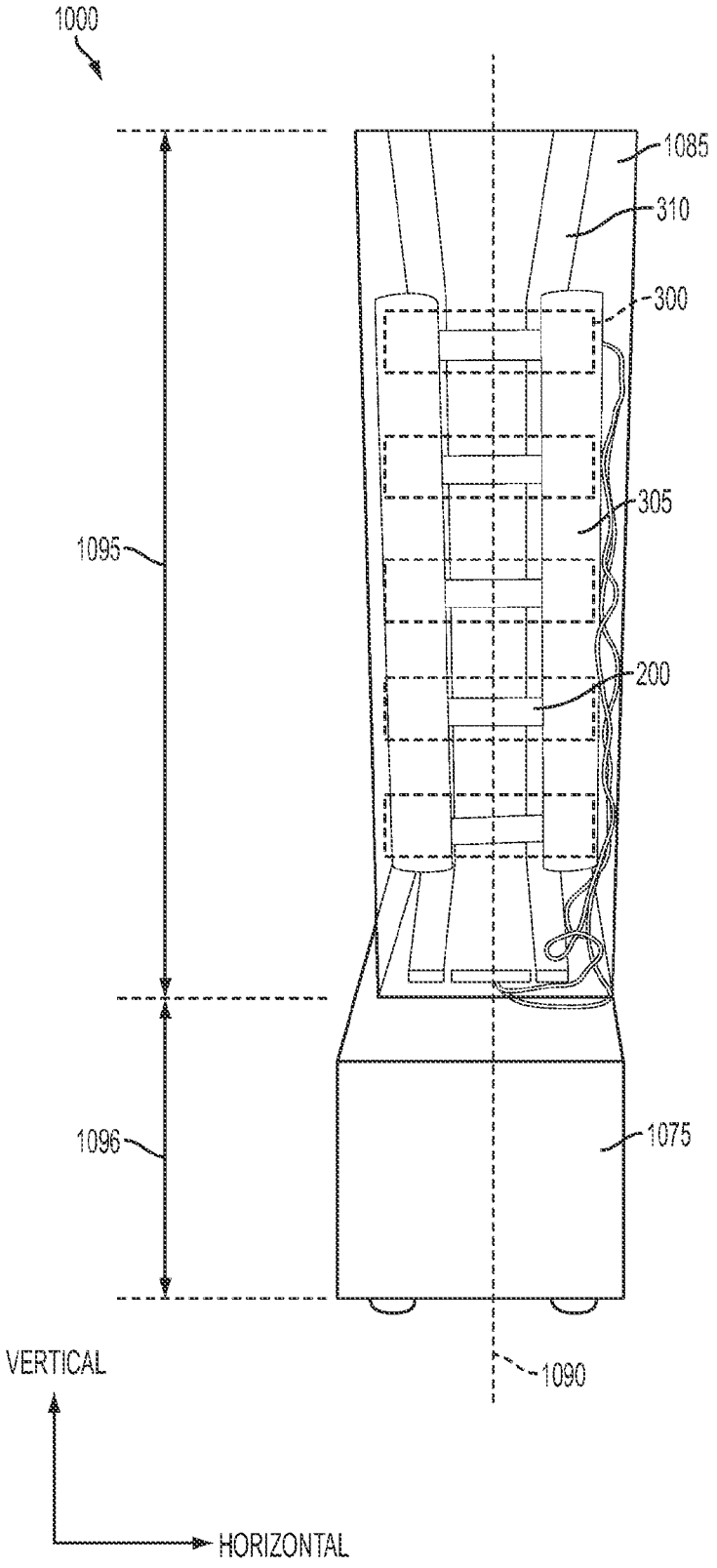
FIG. 10 shows a front view of a piezoelectric loudspeaker in accordance with one or more embodiments of the present disclosure.

FIG. 10 shows speaker 1000 from a front view. As seen, speaker 1000 includes five elements 300 from FIG. 3 arranged in a vertical orientation such that the longer axis of each bimorph 200 lies in a substantially horizontal direction (as indicated in the reference axis of the figure). Each bimorph 200 may spaced equally from one another and/or otherwise arranged linearly along a longitudinal axis 1090 of the speaker 1000. In FIG. 10, elements 300 are seen from the front view as shown in FIG. 3. Each element 300 is illustrated as being enclosed in a dashed box for better viewing. Note that grips 305 in this embodiment comprise two grips that clamp either side of the five bimorphs 200. For example, each grip may include two layers such that the bimorphs 200 are sandwiched between the two layers. Furthermore, support structure 310 is visible that provides a surface on which elements 300 (comprising the components described in FIG. 3) are attached (e.g., via a substrate 1085). The five-element array described previously, the acoustical responses of which was presented in FIGS. 7-9, may be defined by a length 1095. A base 1075, represented by length 1096, provides a larger stand to ensure stability for the rest of speaker 1000.

Figure 11:
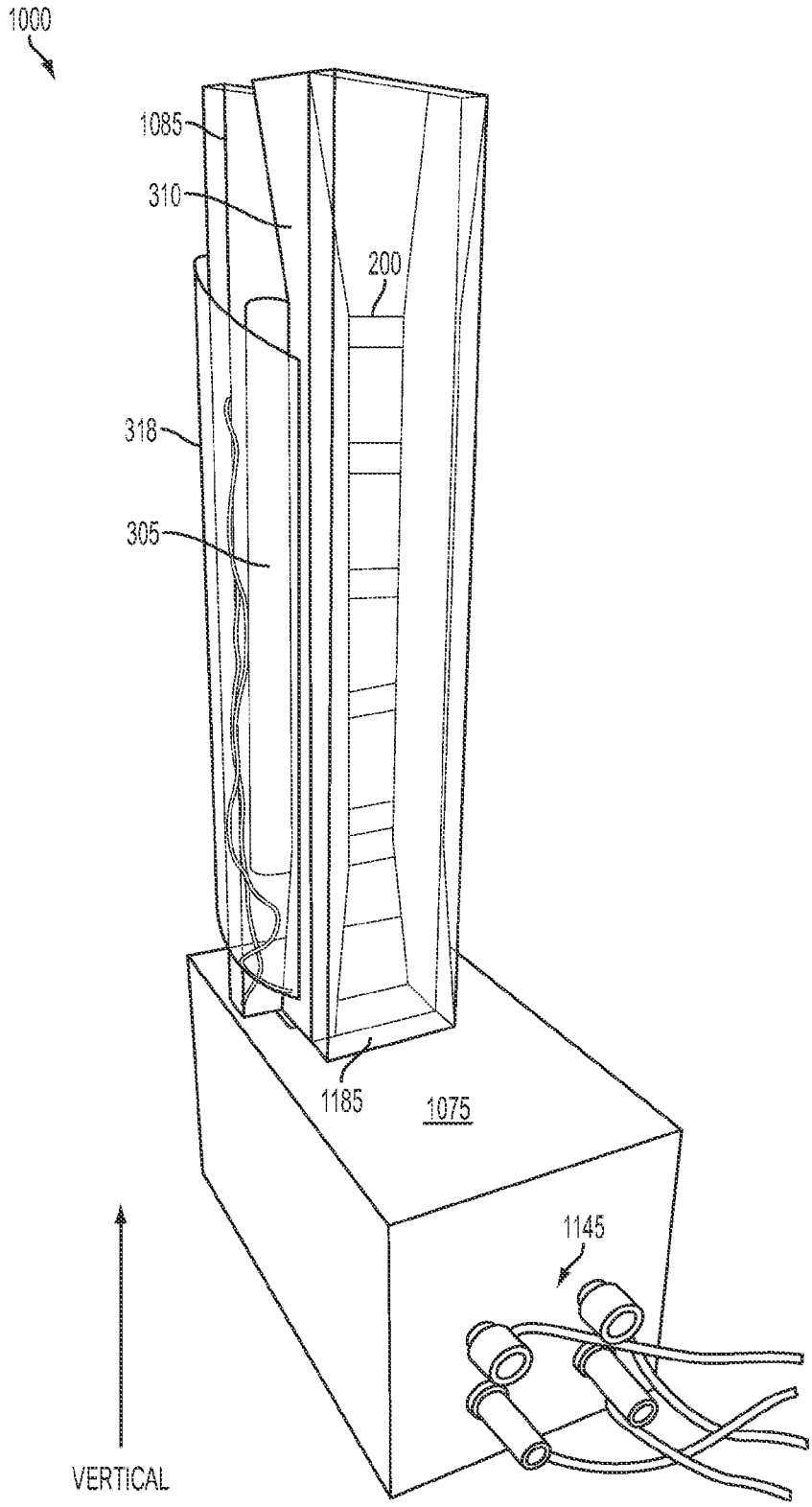
FIG. 11 shows a back view of the loudspeaker of FIG. 10 in accordance with one or more embodiments of the present disclosure.

FIG. 11 shows a rear view of piezoelectric loudspeaker 1000. From this angle, support structure 310 is more clearly visible, wherein structure 310 includes two generally linear beams that are attached to and extend away from base 1075. Base 1075 is attached to electrical wiring 1145 that provide the electrical audio signals from an external source, such as an amplifier or receiver. The clear, hard substrate 1085 is provided that is sandwiched in between post structures 310 and the collective elements of bimorphs 200 and grips 305. Furthermore, another substrate 1185 may be attached to the backside of structures 310 to provide further support for the speaker unit.

Figure 12:
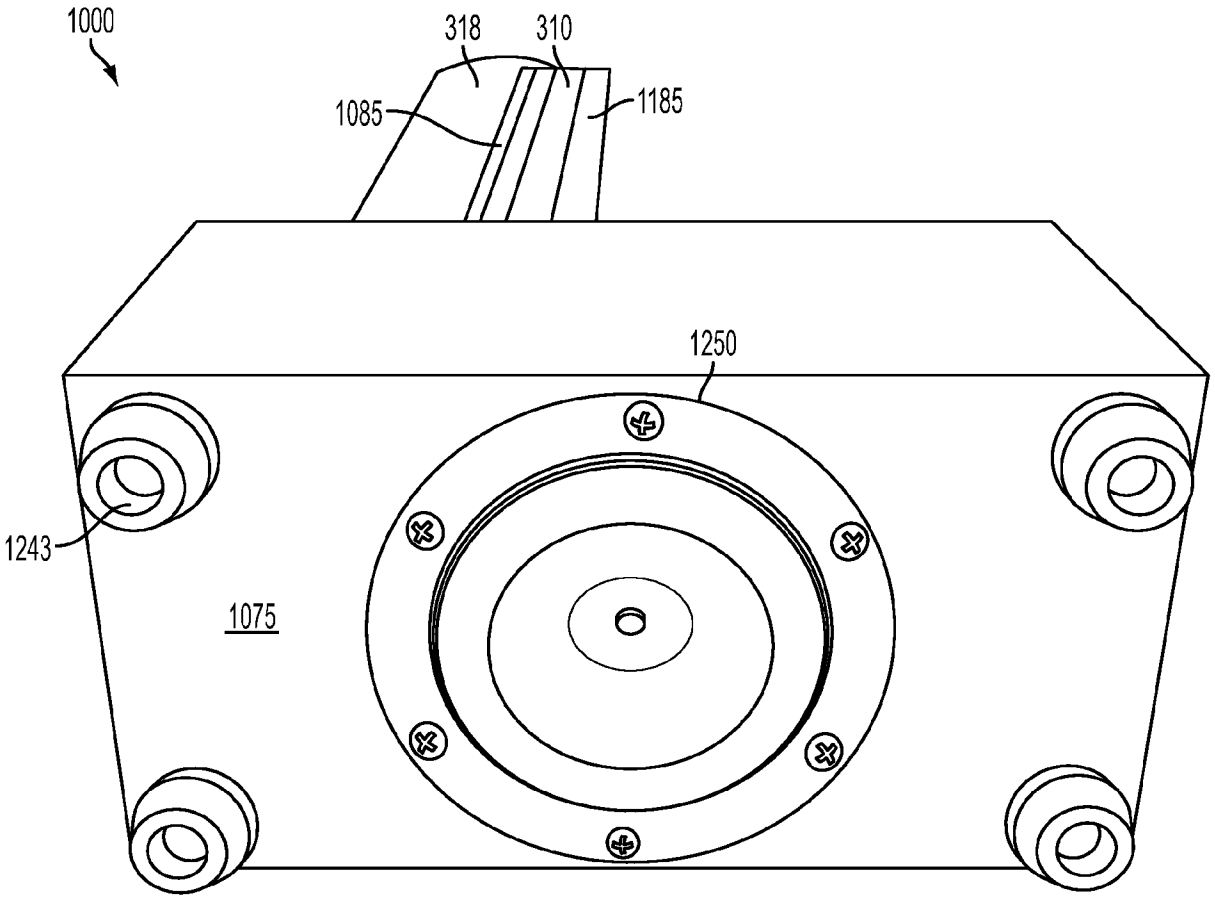
FIG. 12 shows a bottom view of the loudspeaker of FIG. 10 in accordance with one or more embodiments of the present disclosure.

FIG. 12 shows a bottom view of piezoelectric loudspeaker 1000. In this speaker embodiment, base 1075 is equipped with a woofer 1250 that is configured to output the lower-frequency audio sounds of speaker 1000. In this embodiment, the mid-high range frequencies are diverted to the bimorphs 200 via a crossover that is capable of splitting incoming electrical signals. In this example, the woofer may be crossed over at about 650 Hz. As woofer 1250 may be heavier than the combined weight of bimorphs 200 and their related components, placing woofer 1250 in base 1075 provides an anchor for speaker 1000, increasing the speaker's stability and rigidity as vibrations are transmitted through it. Base 1075 may also be provided with several feet 1243 for contacting an external surface, such as a table or a floor. Feet 1243 may be constructed of a damping material such that vibrations are not easily transmitted to the external surface.

Figure 13:
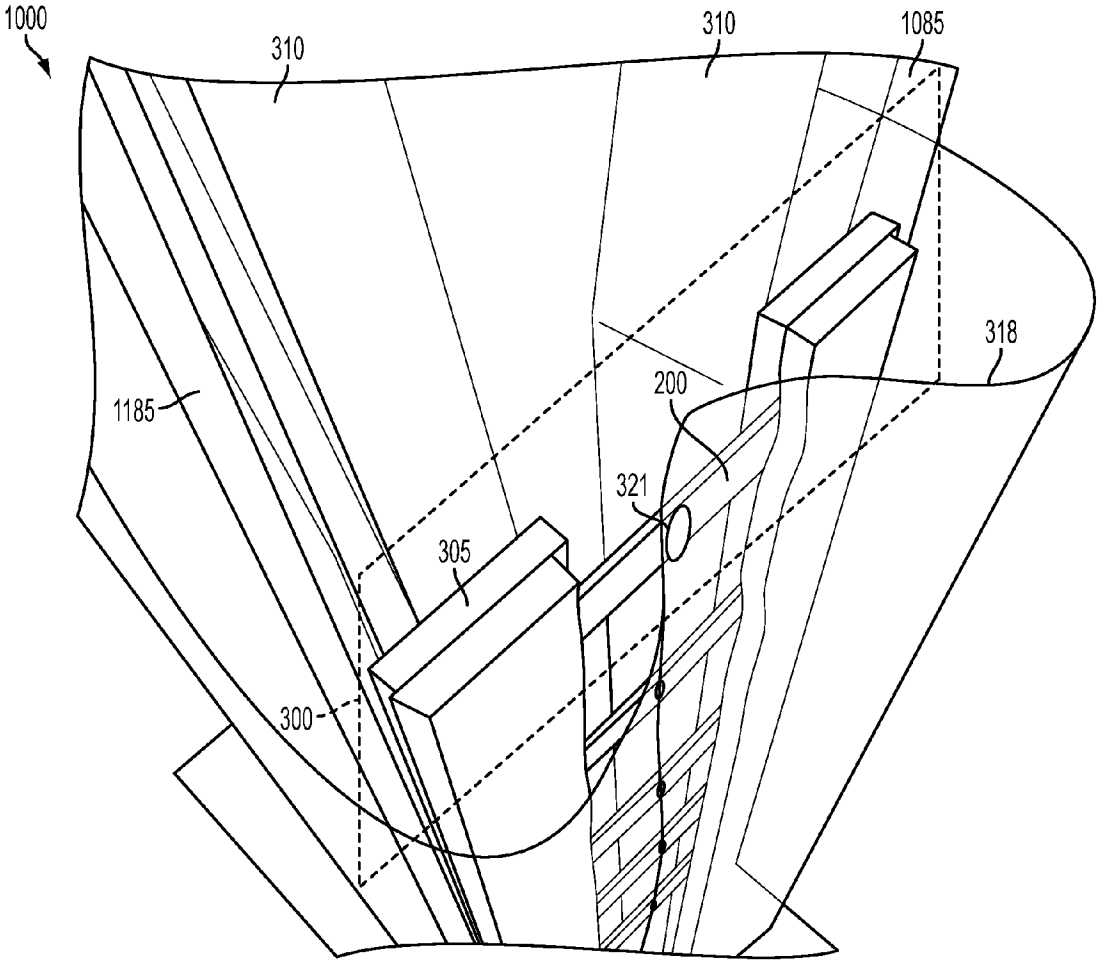
FIG. 13 shows a top view of the loudspeaker of FIG. 10 in accordance with one or more embodiments of the present disclosure.

FIG. 13 shows a top view of piezoelectric loudspeaker 1000. From this angle, a single element 300 is visible, corresponding to element 300 of FIG. 3, as outlined by the dashed box. Membrane 318 is curved in an "M" shape and meets bimorph 200 along line 321. Grips 305 can also be seen gripping bimorph 200. In this embodiment, each end of bimorph 200 is sandwiched between two pieces of rubber forming each grip, and those rubber pieces are extended towards base 1075 (not shown) to grip the other four bimorphs. Furthermore, substrate 1085 can be seen along with posts structures 310.

As previously mentioned with regard to FIG. 12, a crossover may be provided to direct different frequencies to the five-element array of bimorph actuators and the woofer. In this way, the five-element array as represented by length 1095 may produce mid-high range of audio frequencies while woofer 1250, contained within base 1075 and length 1096, produces the lower frequencies. From this, loudspeaker 1000 may function as a dynamic loudspeaker that utilizes magnetic sound-producing elements and conical diaphragms. The five-element array may produce sounds similar in frequency and volume to midrange speakers and/or tweeters that utilize magnetic sound-producing elements.

Figure 14:
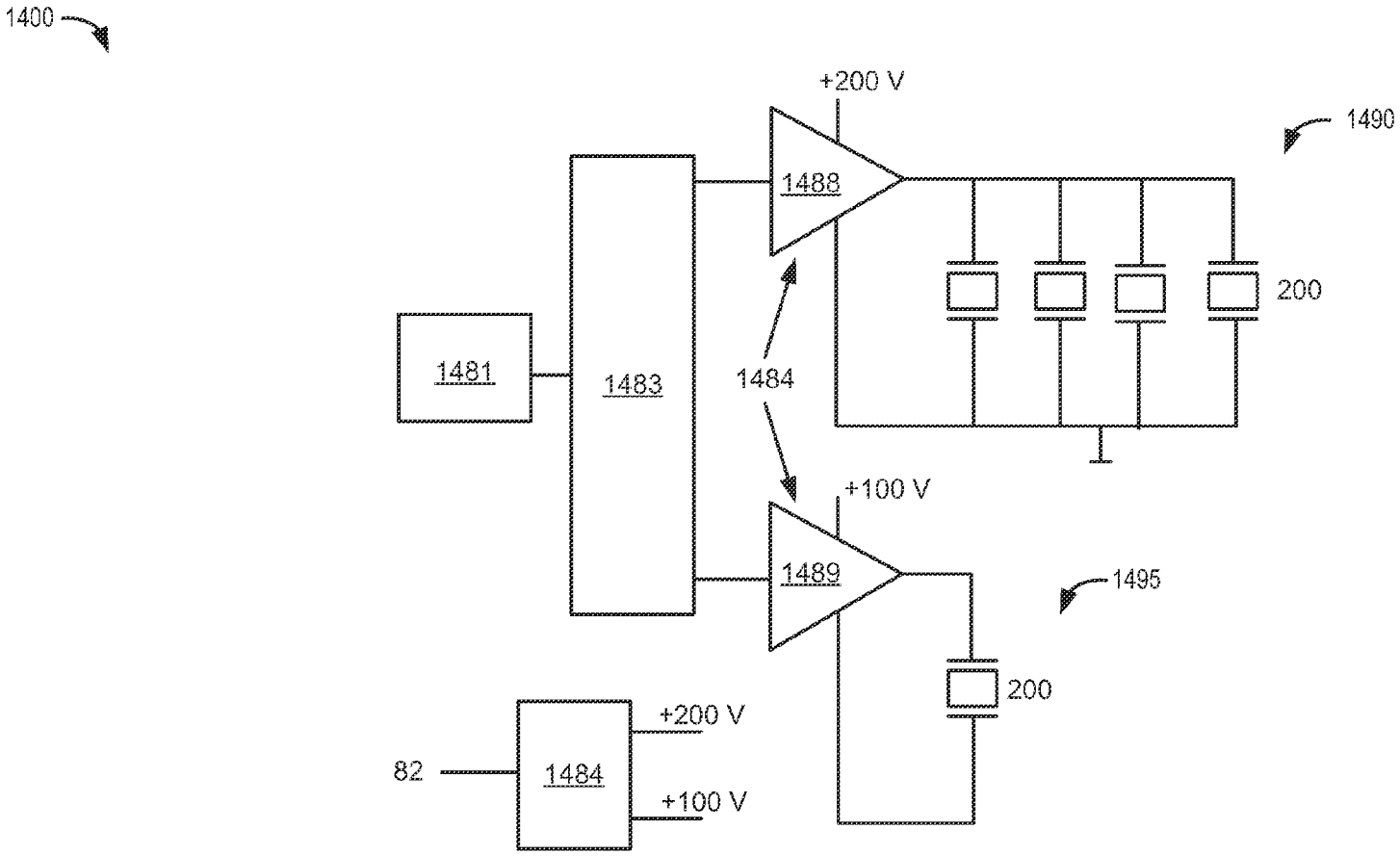
FIG. 14 shows an electronic schematic of a second piezoelectric array in accordance with one or more embodiments of the present disclosure.

A second embodiment of a piezoelectric loudspeaker is shown in FIG. 14, illustrated as a wiring scheme with various electrical elements. As opposed to loudspeaker 1000 that directs the mid-high frequencies to five bimorph actuators 200, speaker 1400 divides the five actuators such that one handles all high frequency sounds in a high-frequency circuit 1495 while the other four handle the low frequency sounds in a low-frequency circuit 1490. An incoming audio signal from external audio source 1481 is separated into two bands by the frequency-dividing network of a crossover 1483. One band may contain the low frequency signal while the other band may contain the high frequency signal, where the division between low and high frequencies is relative depending on a pre-determined frequency. As an example, one band (low band) may comprise frequencies ranging from 200 Hz to 2 kHz, while the second band (high band) may comprise frequencies ranging from 2 kHz to 20 kHz. In this case, 2 kHz would be the pre-determined frequency, or the dividing frequency. A battery 1482 provides power to speaker 1400 via an efficiency low power boost converter 1484, where the converter may provide a pathway with +200 V and another pathway with +100 V for use with the two different frequency paths. Battery 1482 may be a 7 V battery or other type according to the speaker system requirements. Converter 1484 may be a class-D or other appropriate power amplifier. The +200 V and +100 V pathways may then be used to power amplifiers 1488 and 1489, respectively. Amplifier 1488 provides the signal for the low-frequency circuit 1490 while amplifier 1489 provides the signal for the high-frequency circuit 95.

By using separate amplifiers 1488 and 1489, the need for resistors is eliminated, such as the series resistors of FIG. 6, thereby creating a purely reactive load. As a result of having no resistors, power losses due to resistors may be eliminated, thereby reducing the average current the power source (such as battery 1482) must provide. In this way, reactive energy may oscillate between the piezoelectric elements 300 and the power source without drawing any DC current. Consequently, the average power consumption of speaker 1400 may be the combined result of all remaining losses, such as losses from boost converter 1484, crossover 1483, and the piezoelectric elements 300. From the circuit shown in FIG. 14, speaker 1400 may be power-efficient relative to other speakers that do not utilize the power converter and frequency divider of speaker 1400.

Figure 15:
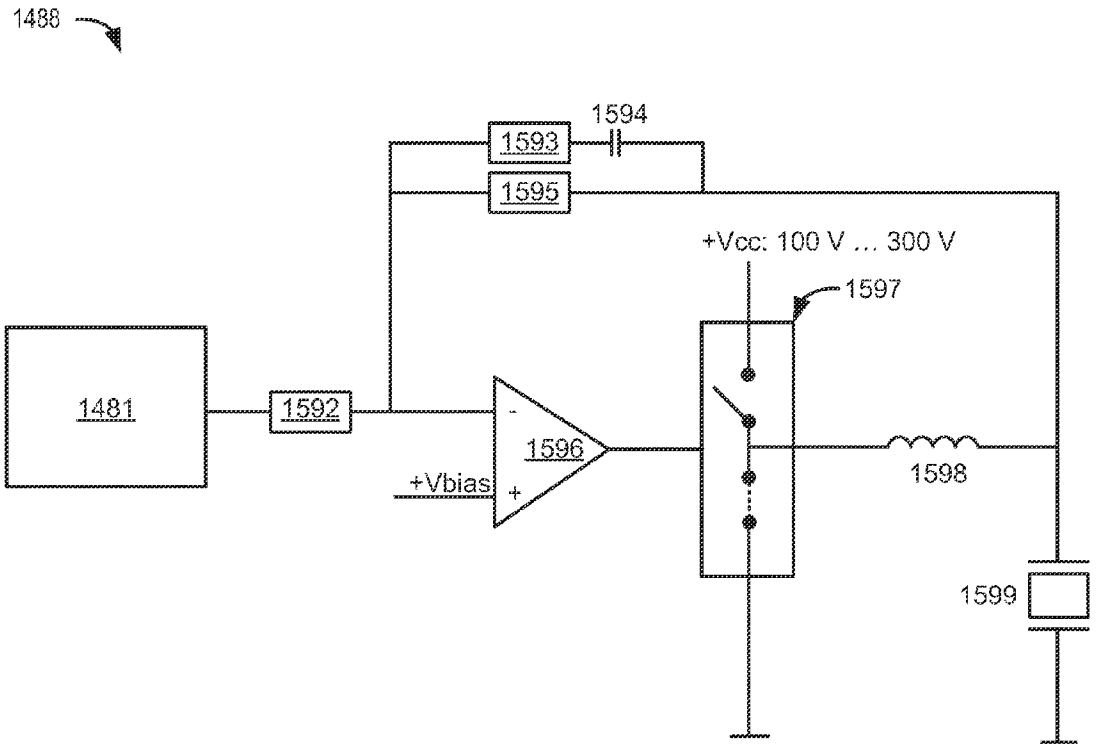
FIG. 15 shows a detailed version of a component of FIG. 14 in accordance with one or more embodiments of the present disclosure.

FIG. 15 shows an example detailed schematic diagram of the amplifier 1488 (or 1489) of FIG. 14. In this example, amplifier 1488 may be a direct-drive class-D amplifier. Audio source 1481 provides an audio signal through a resistor 1592, where the signal is then passed in parallel through different elements. In one line of the parallel circuit, forming a passive feedback network, another resistor 1593 is provided in series with a capacitor which are in parallel with a third resistor 1595. A comparator 1596, power switch 1597, and an inductor 1598 (e.g., a 100 uH inductor) are provided in series in the second line of the parallel circuit. A piezoelectric element 1599, which may by any of the bimorph actuators 200 of FIG. 14, provides the capacitive part of the LC low-pass network that may be needed to reconstruct the analog audio signal from the switched signal. The values of inductor 1598, resistor 1593, and capacitor 1594, along with the latency of comparator 1596 and power switch 1597, may determine the carrier (idle) frequency of the modulator, presented in FIG. 15 as resistor 1592, and the audio gain, presented in FIG. 15 as resistor 1595. For this example system setup, values for several of the components may be resistor 1593=2000 ohms, resistor 1595=200 k ohms, resistor 1593=10 k ohms, and capacitor 1594=150 pF. Other values may be used depending on the speaker requirements and particular circuit.

Figure 16:
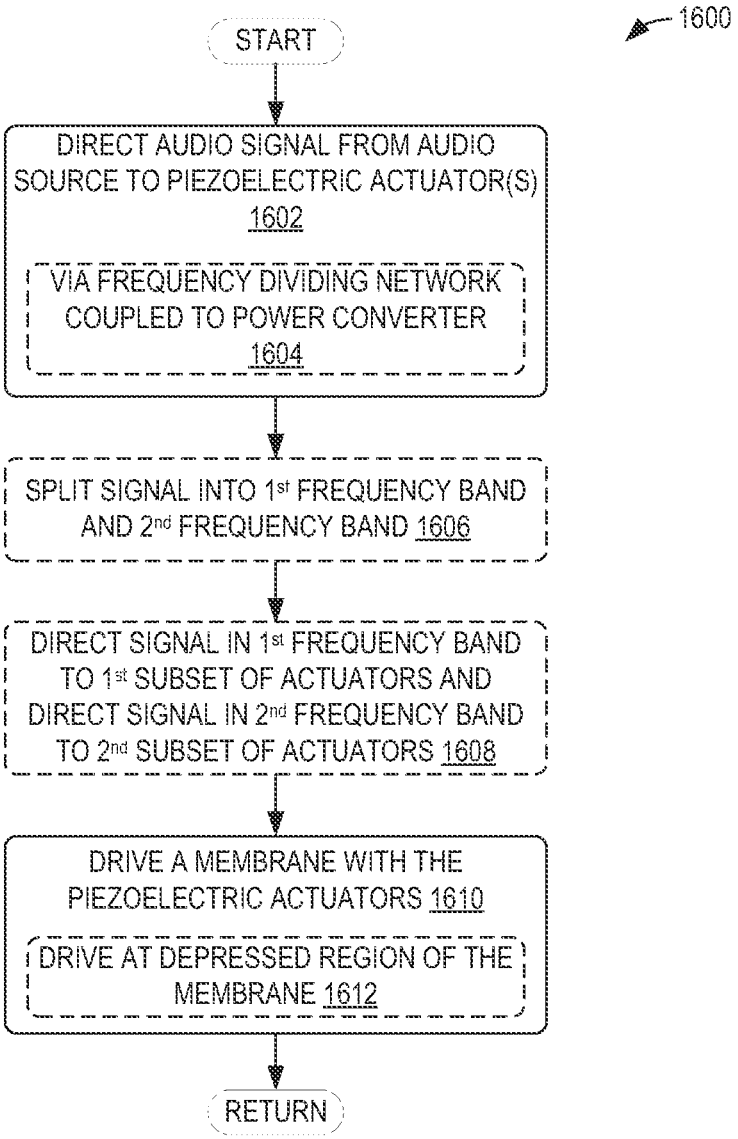
FIG. 16 is a flow chart of a method for generating sound in a loudspeaker in accordance with one or more embodiments of the present disclosure.

FIG. 16 is a flow chart of a method 1600 for generating sound. For example, method 1600 may be performed by one or more of the disclosed loudspeakers and/or associated circuitry. The method 1600 may include directing an audio signal from an audio source to one or more piezoelectric actuators, as indicated at 1602. As indicated at 1604, the directing may be performed via a frequency dividing network coupled to a power amplifier, as described in more detail in FIGS. 14 and 15. The method 1600 may include separating the signal into a first and second frequency band, as indicated at 1606. Upon separating the signal, the method 1600 may include directing a portion of the audio signal in the first frequency band (e.g., all of the signal that is within a range of frequencies defined by the first frequency band) to a first subset of piezoelectric actuators and directing a portion of the signal in the second frequency band (e.g., all of the signal that is within a range of frequencies defined by the second frequency band) to a second subset of actuators, as indicated at 1608. At 1610, the method 1600 includes driving a membrane (e.g., membrane 318 of FIG. 3) with the one or more piezoelectric actuators, for example at a depressed region of the membrane, as indicated at 1612.

Piezo-driven loudspeakers may eliminate bulky, costly magnets from the loudspeaker and increase power efficiency relative to magnet-driven loudspeakers. Driving the membrane at a depressed region of the membrane and gripping the piezoelectric actuators at each end of the actuator as described above enables the vibrations of the piezoelectric actuator to be distributed evenly along the membrane. By driving a membrane with piezoelectric actuators as described above, the weight- and cost-saving features described above may be realized without sacrificing bandwidth or other audio quality parameters in the loudspeaker.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

The invention claimed is:

1. A loudspeaker comprising:

a support structure;

a plurality of piezoelectric layered actuators affixed to the support structure via at least two grips;

a membrane suspended over the plurality of piezoelectric actuators, the membrane being in contact with the plurality of piezoelectric actuators between the at least two grips; and the entire membrane having an M-shaped profile in a first plane and the entire membrane having a flat profile in a second plane, the first plane being orthogonal to a surface of the plurality of piezoelectric actuators and the second plane being orthogonal to the first plane.

2. The loudspeaker of claim 1, wherein the plurality of piezoelectric actuators are piezoelectric bimorph actuators, and wherein the entire membrane further has a flat profile in a third plane, the third plane being orthogonal to each of the first and second planes.

3. The loudspeaker of claim 1, wherein each of the at least two grips is attached to a different end of the plurality of piezoelectric actuators.

4. The loudspeaker of claim 1, wherein the at least two grips comprise a rubber material, and the plurality of piezoelectric actuators forms a cantilever.

5. The loudspeaker of claim 1, wherein the at least two grips are affixed to a first surface of the support structure, and wherein a post structure is affixed to a second surface of the support structure lateral to the first surface, and wherein the membrane is further affixed to the post structure.

6. The loudspeaker of claim 5, wherein each of the at least two grips includes two layers, and wherein the plurality of piezoelectric actuators are clamped between the two layers of each of the at least two grips, and wherein the membrane is attached to an outer surface of the post structure, the outer surface being a surface of the post structure located furthest in a direction from the support structure toward the plurality of piezoelectric actuators.

7. The loudspeaker of claim 6, wherein the membrane is in contact with a center of each of the piezoelectric actuators, and wherein the membrane protrudes beyond the support structure, post structure, and grips in the direction from the support structure toward the piezoelectric actuators.

8. The loudspeaker of claim 1, wherein the plurality of piezoelectric actuators make up an array of piezoelectric actuators, wherein each piezoelectric actuator in the array of piezoelectric actuators is affixed to the support structure via each of the at least two grips.

9. The loudspeaker of claim 8, wherein the array of piezoelectric actuators is arranged linearly along a longitudinal axis of the loudspeaker, the membrane contacting the piezoelectric actuators along a line on the longitudinal axis.

10. The loudspeaker of claim 9, further comprising:

A woofer; and a frequency dividing network coupled to a power converter, wherein each piezoelectric actuator in the array of piezoelectric actuators is spaced equally from one another, and the frequency dividing network is configured to divide a signal into a first frequency band and a second frequency band, the first frequency band higher than the second frequency band, to send the first frequency band to the array of piezoelectric actuators, and to send the second frequency band to the woofer.

11. The loudspeaker of claim 1, wherein each end of the membrane is fixed to the support structure, the M-shaped profile of the membrane being curved.

12. The loudspeaker of claim 1, wherein the membrane is driven by the plurality of piezoelectric actuators.

13. A loudspeaker comprising:

a support structure;

an array of piezoelectric layered actuators arranged linearly along a longitudinal axis of the loudspeaker, each piezoelectric actuator of the array of piezoelectric actuators being affixed to the support structure via at least two grips, each grip of the at least two grips being shared by each piezoelectric actuator in the array; and a membrane suspended over the array of piezoelectric actuators, the membrane being in contact with each of the piezoelectric actuators at a first point between the at least two grips, the membrane being in contact with the support structure at a second point, and the membrane having a curved profile which is smooth at all points between the first and second points.

14. The loudspeaker of claim 13, wherein each of the piezoelectric actuators is centered on the longitudinal axis and wherein the first point is at a location on the longitudinal axis, and wherein the membrane protrudes beyond the support structure and the grips in a forward direction, the forward direction being perpendicular to a front surface of the piezoelectric actuators and extending from the support structure toward the membrane.

15. The loudspeaker of claim 14, wherein the first point is at a center of the front surface of the piezoelectric actuators and the membrane is spaced away from the piezoelectric actuators at each other region of the front surface of the piezoelectric actuators, and wherein the second point is on an outer surface of the support structure, the outer surface being a surface located furthest in the forward direction.

16. The loudspeaker of claim 14, wherein each grip of the at least two grips is coupled to a different end of each piezoelectric actuator in the array of piezoelectric actuators, and wherein the first point is located along a central line.

17. A method of generating sound in a loudspeaker, the method comprising: driving a membrane with a plurality of piezoelectric actuators at a depressed region of the membrane, wherein the membrane is suspended over the plurality of piezoelectric actuators, wherein the membrane is in contact with the plurality of piezoelectric actuators between a pair of grips, and wherein the plurality of piezoelectric actuators are affixed to a support structure via the pair of grips, and directing an audio signal from an audio source to the plurality of piezoelectric actuators via a frequency dividing network coupled to a power converter, the frequency dividing network separating the audio signal into a first frequency band and a second frequency band, wherein the entire membrane has an M-shaped profile in a first plane and the entire membrane has a flat profile in second and third planes, the first plane being orthogonal to a surface of the plurality of piezoelectric actuators and a longitudinal axis of the loudspeaker, the second and third planes being orthogonal to the first plane, and the third plane being orthogonal to the second plane.

18. The method of claim 17, wherein the plurality of piezoelectric actuators comprises an array of piezoelectric actuators arranged along the longitudinal axis of the loudspeaker and wherein driving the membrane comprises driving the membrane with each of the piezoelectric actuators in the array at the depressed region of the membrane, and wherein the membrane is affixed to each piezoelectric actuator in the array of piezoelectric actuators and to the support structure, the M-shaped profile of the membrane curving smoothly between the array of piezoelectric actuators and the support structure, and the membrane extending beyond the support structure in a direction from the support structure toward the piezoelectric actuators in the array.

19. The method of claim 18, further comprising directing a portion of the audio signal in the first frequency band to a first subset of one or more piezoelectric actuators in the array and directing a portion of the audio signal in the second frequency band to a second subset of one or more piezoelectric actuators in the array, and wherein each of the piezoelectric actuators in the array is affixed to the support structure by the pair of grips, the pair of grips being shared by all piezoelectric actuators in the array.

20. The method of claim 19, wherein the first frequency band is lower than the second frequency band, the first subset consists of a plurality of piezoelectric actuators, and the second subset consists of a single piezoelectric actuator.

* * * * *